US005863146A

United States Patent [19]

Denkins et al.

[11] Patent Number: 5,863,146

[45] Date of Patent: Jan. 26, 1999

[54] APPARATUS FOR APPLYING JOINT COMPOUND

[75] Inventors: Jeffrey L. Denkins; Steven J. Mondlock, both of Kaukauna, Wis.

[73] Assignee: Apla-Tech, Inc., Kaukauna, Wis.

[21] Appl. No.: 659,284

[22] Filed: Jun. 6, 1996

[51] Int. Cl.[6] ..... B05C 17/015

[52] U.S. Cl. ..... 401/188 R; 401/171; 401/176; 401/266; 401/263

[58] Field of Search ..... 401/171, 176, 401/187, 188 R, 266, 263; 222/389, 391

[56] References Cited

U.S. PATENT DOCUMENTS

| | | | |
|---|---|---|---|
| 2,502,499 | 4/1950 | Ames | 216/22 |
| 2,815,142 | 12/1957 | Ames | 216/25 |
| 3,007,837 | 11/1961 | Goode | 156/461 |
| 3,116,195 | 12/1963 | Lathrop et al. | 156/575 |
| 3,131,108 | 4/1964 | Kennard | 156/461 |
| 3,188,262 | 6/1965 | Torrison | 156/575 |
| 3,374,049 | 3/1968 | Taylor | 401/171 |
| 3,707,427 | 12/1972 | Erickson | 156/575 |
| 3,921,858 | 11/1975 | Bemm | 401/188 R X |
| 4,080,240 | 3/1978 | Dysart | 156/575 |
| 4,086,121 | 4/1978 | Ames | 156/526 |
| 4,090,914 | 5/1978 | Hauk et al. | 156/523 |
| 4,105,490 | 8/1978 | Lass | 156/526 |
| 4,127,434 | 11/1978 | Lass | 156/526 |
| 4,309,238 | 1/1982 | Hauk | 156/575 |
| 4,358,337 | 11/1982 | Johnson | 156/526 |
| 4,516,868 | 5/1985 | Molnar | 401/5 |
| 4,732,503 | 3/1988 | Bader et al. | 401/197 |
| 5,169,160 | 12/1992 | Gaskill et al. | 277/68 |
| 5,279,700 | 1/1994 | Retti | 156/578 |
| 5,465,881 | 11/1995 | Zwicky | 222/389 |

FOREIGN PATENT DOCUMENTS

| | | | |
|---|---|---|---|
| 710121 | 5/1965 | Canada | 222/391 |
| 1031738 | 6/1958 | Germany | 222/389 |

*Primary Examiner*—Steven A. Bratlie

*Attorney, Agent, or Firm*—Andrus, Sceales, Starke & Sawall

[57] ABSTRACT

An apparatus for applying joint compound is externally powered, preferably using compressed air. The preferred apparatus has a hollow tubular storage body that is connected to a supply of compressed air, and a movable plunger positioned within the hollow tubular storage body. The plunger has a pair of rubber seals that contact the inner wall of the storage body. A supply of joint compound is inserted into the storage body on the side of the plunger opposite the side of the plunger that can be exposed to pressurized air. Pressurized air can be supplied by the user against the plunger to push the supply of joint compound out of the storage body through a mud supply head. An applicator tip is connected to the mud supply head and can be connected to either a flat joint attachment or a corner joint attachment. Alternatively, other attachments can be used such as a texture gun attachment, a fireproofing attachment, or a water cleaning attachment.

31 Claims, 5 Drawing Sheets

12
14
25
26
27
28
30
32
34
36
38
42
44
46
48
50
52
60
66
76
96
98
100
102
106
108
110
112
114
116
120
124
128
130
132
134
136
138
140
142
182
184
186
188

FIG. 5
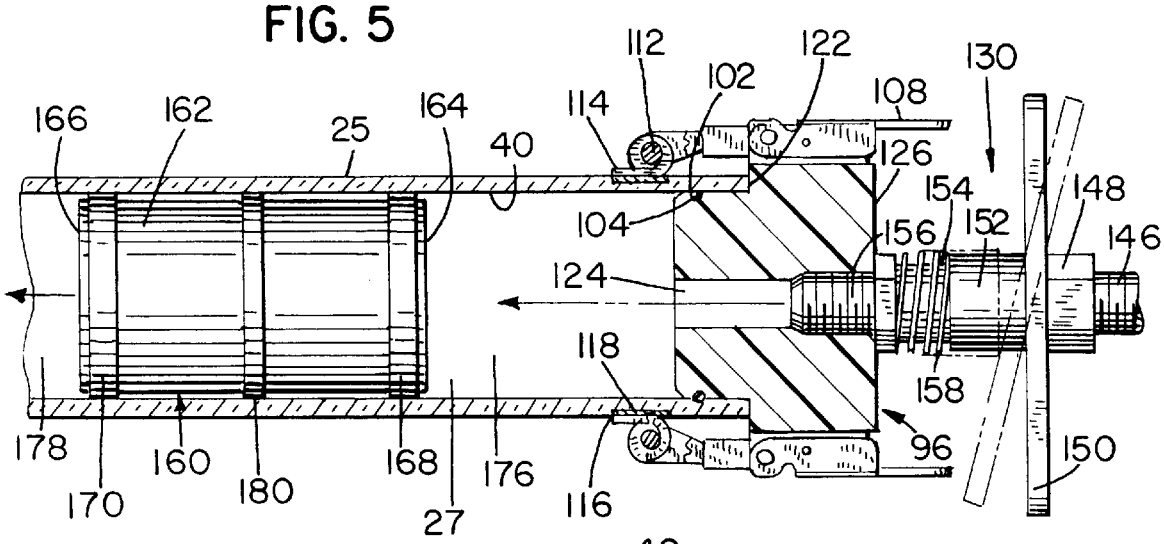
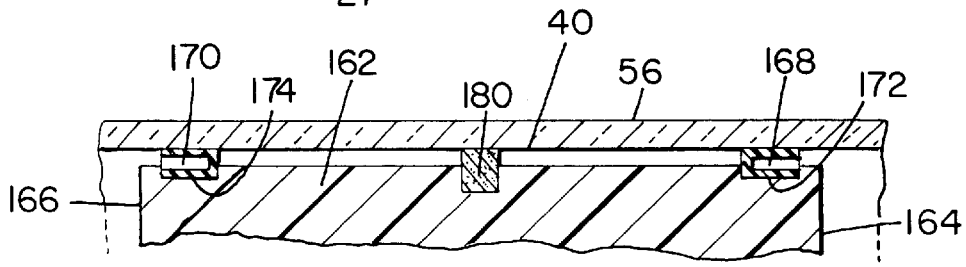
FIG. 6
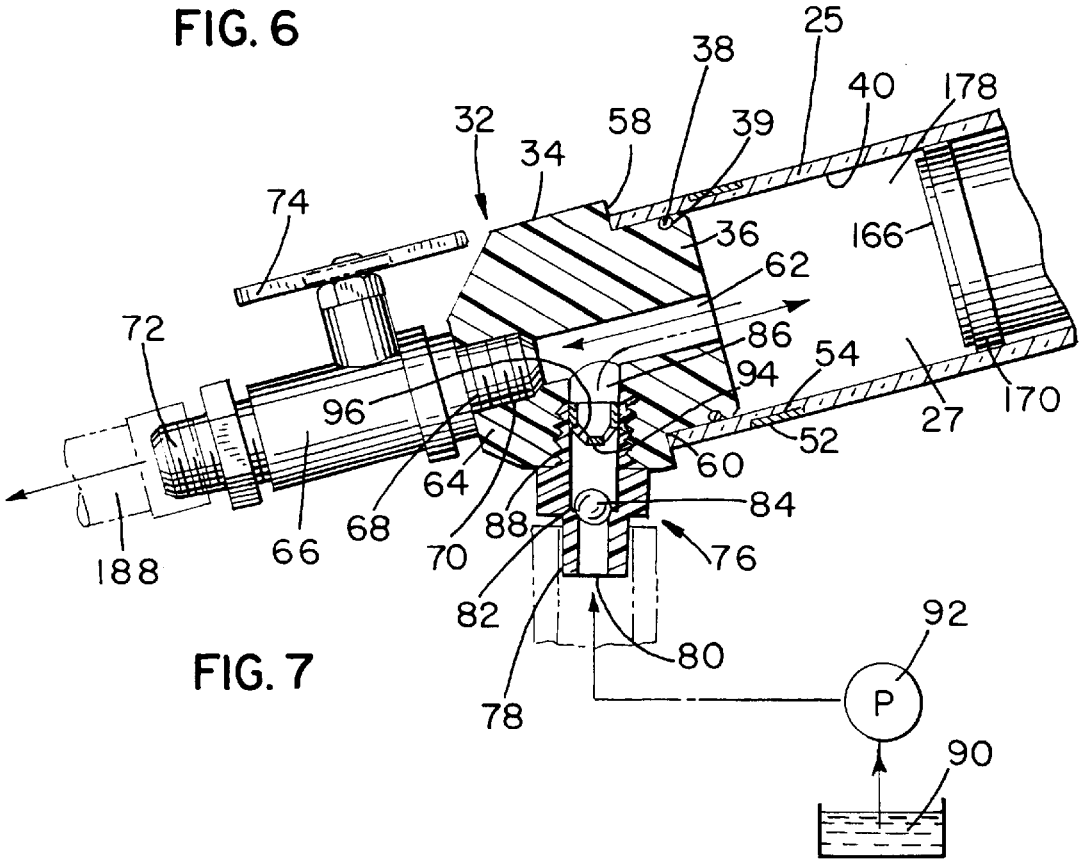
FIG. 7

134
139
214
216
150
26
212
12
20
66
218
210
220
222

134
139
12
74
224
22
226
230
228

134
139
150
12
26
74
66
72
238
24
236
234
240

APPARATUS FOR APPLYING JOINT COMPOUND

FIELD OF THE INVENTION

The invention relates to the application of joint compound on joints between sheets of drywall. In particular, the invention relates to an externally powered apparatus for applying joint compound over adhesive-backed drywall tape, such as reinforced adhesive-backed drywall tape or mesh tape.

BACKGROUND OF THE INVENTION

Conventional drywall tape is typically made of paper and does not have an adhesive backing. The tape is secured over joints between sheets of drywall with a joint compound, sometimes referred to as "mud". Prior art devices such as those disclosed in U.S. Pat. Nos. 4,652,331; 4,086,121; 5,013,389; and 3,960,643 have been developed to contemporaneously apply conventional drywall tape and mud to seal drywall joints. In these devices, tape is coated with mud as the tape is drawn through rollers from a continuous roll of tape. The mud-coated tape is then applied over drywall joints and pressed into place with the rollers. Even with these prior art devices, the process of applying conventional drywall tape with mud is labor intensive and time consuming.

Reinforced adhesive-backed drywall tape, otherwise known as mudless tape, can reduce the amount of labor and time involved in drywalling. Reinforced adhesive-backed drywall tape adheres directly to the drywall over joints between two sheets of drywall. Adhesive-backed mesh tape can also be applied directly over drywall joints. Many devices have been developed to apply mudless tape or mesh tape over drywall joints, including Denkins U.S. patent application Ser. No. 08/547,996, filed Oct. 25, 1995. After adhesive-backed tape is applied over a drywall joint, a layer of mud must be subsequently applied over the tape.

While the use of reinforced adhesive-backed drywall tape or mesh tape is typically more time efficient than conventional non-adhesive tape, problems currently exist in applying the finishing layer of mud over adhesive-backed tape or mesh. For example, when applying the finishing layer of mud over mesh or mudless tape the drywaller must be very careful to not rip or tear the mesh. Since the drywaller must apply the finishing mud carefully, the amount of time saved by using mudless tape or mesh is often negated by the additional time needed to apply the finishing layer of mud over the mudless tape or mesh.

It is therefore desirable that an easy to use and efficient apparatus be available for applying mud over mudless tape or mesh in both straight joints and corner joints. The drywaller should be able to apply mud in a quick and easy manner without worrying about ripping or tearing the tape or mesh positioned over the joints between drywall sections.

SUMMARY OF THE INVENTION

The invention is an externally powered mud dispenser that efficiently supplies and applies joint compound over adhesive-backed mudless drywall tape or mesh both along flat joints and corner joints between sections of drywall. The invention can also be converted, using a series of attachments, to perform several other drywall-related functions.

An apparatus in accordance with the invention, has a common dispenser having a hollow storage body for storing a supply of joint compound, a removable mud supply head mounted to the top end of the storage body, and a removable power supply head mounted to the bottom end of the storage body. A movable plunger is positioned between the power supply and mud supply heads within the storage body. Joint compound or mud filling the storage body can be pushed by the plunger through a passageway in the power supply head to apply the joint compound to the wall being finished.

The power supply head is preferably connected to a supply of pressurized air (e.g. a compressor) through an actuator and a pressure regulator. The pressure regulator acts to control the maximum amount of air pressure that can be applied to push the plunger through the storage body. The actuator has an actuator handle that can be pivoted to allow the compressed air to enter the storage body and push the plunger.

A shut-off valve and a fill valve are connected to the mud supply head. The fill valve is a one-way valve that allows joint compound or some other liquid to be supplied to the open interior of the storage body. Once the storage body is full, the one-way fill valve prevents the joint compound from exiting back through the fill valve.

The shut-off valve can be selectively opened or closed by the user. During normal operation, the shut-off valve is open, which allows the joint compound to flow out of the storage body onto the drywall surface. During filling, the shut-off valve is closed to prevent the joint compound from flowing out of the storage body.

An applicator tip having a mounting ball is removably mounted to the shut-off valve so that joint compound passing through the shut-off valve eventually exits through the applicator tip. The mounting ball permits the attachment of either a flat or a corner joint attachment.

To use the common dispenser, the drywall worker depresses the actuator handle to supply pressurized air into the storage body. The compressed air pushes the movable plunger along the longitudinal length of the storage body and away from the power supply head. This movement of the plunger forces the joint compound through the mud supply head, through the applicator tip and out of the flat or corner joint attachments onto the drywall surfaces.

The movable plunger positioned within the storage body contains a pair of rubber seals that contact the inner wall of the storage body. The first rubber seal seals the compressed air. The second rubber seal seals joint compound contained in the storage body. Preferably, a moistened felt lubricating strip is positioned around the plunger between the first and second seals so that the inner wall of the storage body is lubricated to facilitate plunger movement within the storage body.

The invention also contemplates a kit in which the common dispenser, previously described, can use a number of various attachments, including a flat joint attachment, a corner joint attachment, a texture gun attachment, a fireproofing attachment, and a water cleaning attachment. The texture gun attachment includes a spray nozzle that can be used with pressurized air to splatter joint compound over a section of drywall to create a textured finish as is well known in the drywall art. The fireproofing attachment can be used by a drywaller to apply a bead of joint compound in an open gap, as required to fireproof a room. The water attachment includes a spray nozzle attached to a water hose. The storage body of the common dispenser can be filled with water, and the dispenser can be used to provide a source of pressurized water. The water attachment can therefore be used by drywall workmen to effectively clean the drywalling tools after completing a job.

Other advantages and features of the invention will be apparent upon reviewing the drawings and the following description thereof.

BRIEF DESCRIPTION OF THE DRAWINGS

The drawings illustrate the best mode presently contemplated of carrying out the invention.

In the drawings:

FIG. 5 is a partial sectional view of the rear end of the apparatus shown in FIG. 1 showing the interaction between the plunger and the storage body;

FIG. 6 is a detailed partial cross-sectional view showing the interaction between the pair of seals contained on the plunger body and internal wall of the storage body;

FIG. 7 is a partial sectional view of the mud supply head of the apparatus shown in FIG. 1;

DETAILED DESCRIPTION OF THE DRAWINGS

Figure 1:
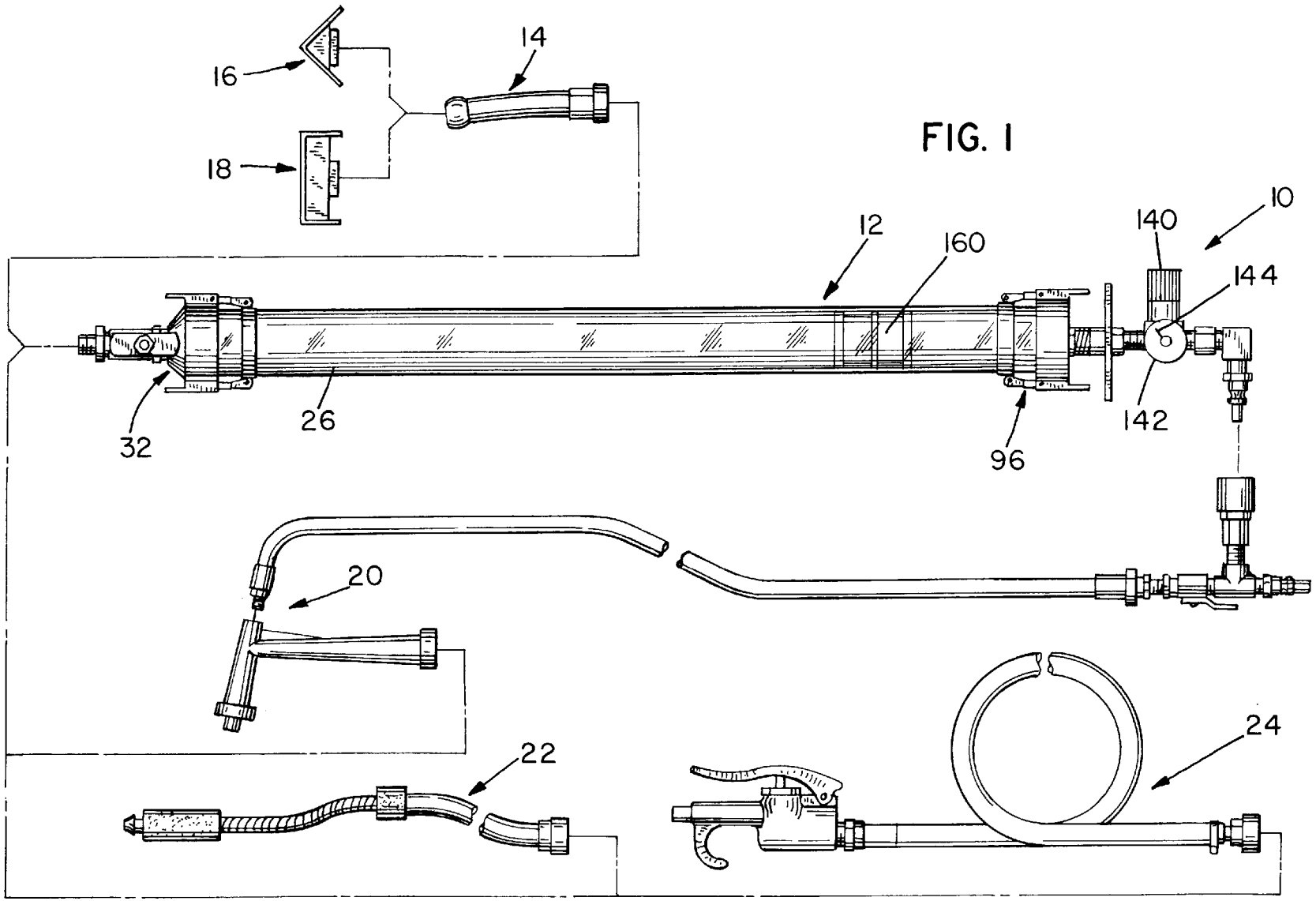
FIG. 1 illustrates a kit in accordance with the invention including a dispenser body and an assortment of peripheral devices for applying joint compound or other liquefied materials.

FIG. 1 shows the components of a kit 10 for applying joint compound over flat and corner joints between sheets of wallboard, as well as for generally supplying the joint compound or other liquefied materials or liquids for various other purposes. The components of kit 10 include a common dispenser 12, an applicator tip 14, and a set of attachments, each of which can be removably attached to the applicator tip 14. The removable attachments include: a corner joint attachment 16, a flat joint attachment 18, a texture gun attachment 20, a fireproofing attachment 22, and a water cleaning attachment 24. The single kit 10 replaces several conventional drywall tools which previously had to be purchased separately. The kit 10 is useful primarily in applying joint compound over previously taped joints between sections of drywall, particularly joints that have been taped with adhesive-backed mudless tape or mesh. In addition, the texture gun attachment 20, the fireproofing attachment 22, and the water cleaning attachment 24 can be used along with the common dispenser 12 to perform several other tasks which are often carried out by drywall workmen. For example, the texture gun attachment 20 can be used to create a textured surface over an otherwise smooth piece of drywall. The fireproofing attachment 22 is useful in filling the open space between a section of drywall and a pipe entering the room. The water cleaning attachment 24 is particularly useful in cleaning the drywall tools after a construction project has been completed.

Figures 2, 3, 4:
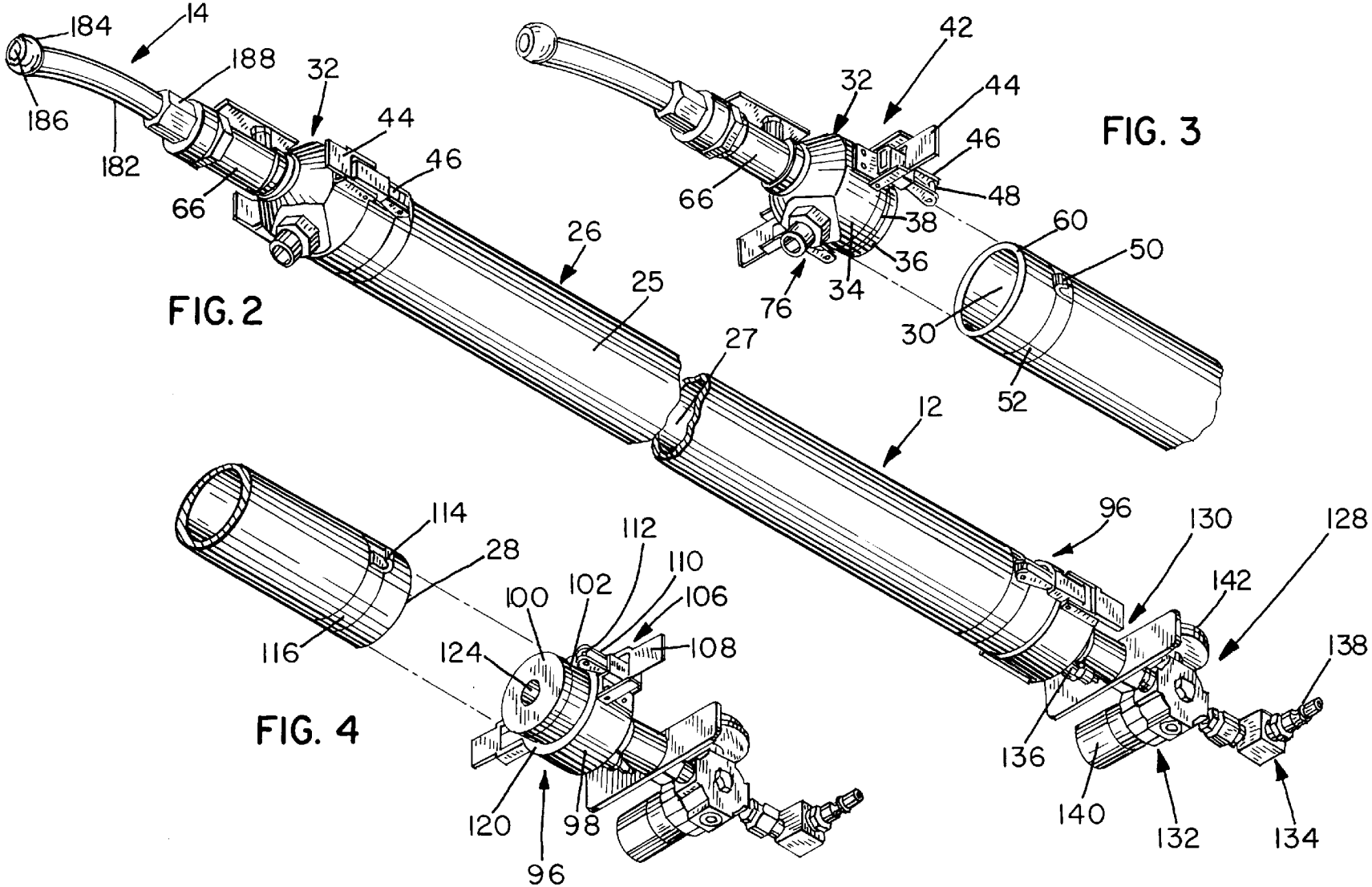
FIG. 2 is a perspective view of the apparatus in accordance with the invention for supplying joint compound to be applied over taped joints between sections of wallboard.
FIG. 3 is an exploded perspective view showing the removable mud supply head of the apparatus shown in FIG. 2.
FIG. 4 is an exploded perspective view showing the removable power supply head of the apparatus shown in FIG. 2.

FIGS. 2–4 illustrate the common dispenser 12 with the applicator tip 14 removably connected thereto. The common dispenser 12 includes a hollow tubular storage body 26 that extends lengthwise along a longitudinal axis. The storage body 26 includes a cylindrical outer wall 25 surrounding and defining an internal open area 27. The outer wall 25 terminates at an open bottom end 28 and an open top end 30. Both the bottom end 28 and the top end 30 of the storage body 26 have a circular cross section.

A mud supply head 32 is removably connected to the top end 30. The mud supply head 32 has a generally cylindrical body 34 with an outer diameter slightly larger than the outside diameter of the storage body 26. The mud supply head body 34 has a cylindrical mounting portion 36. The mounting portion 36 has an outer diameter sized slightly smaller than the internal diameter of the top end 30 so that the mounting portion 36 can be positioned within top end 30 of the storage body 26. A rubber seal 38 surrounds the outer diameter of the mounting portion 36. The rubber seal 38 is retained in a circumferential notch 39 extending around the outer surface of the mounting portion 36. When the mounting portion 36 of the mud supply head 32 is inserted into the top end 30 of the storage body 26, the rubber seal 38 interacts with the inner wall 40 of the storage body 26 to provide a liquid and air-tight seal (see FIG. 7).

Referring to FIG. 3, a pair of latches 42 are securely connected to the body 34 of the mud supply head 32. Each of the latches 42 contains an actuation handle 44 pivotally connected to an attachment body 46. The attachment body 46 includes a rod 48. A pair of corresponding catch members 50 are securely connected to a metal band 52 that surrounds the outside diameter of the storage body 26 and is spaced longitudinally from the top end 30 of the storage body 26. As shown in FIG. 7, the metal band 52 is received in a circumferential notch 54 formed in the outer wall 25 of the storage body 26.

When the mud supply head 32 is mounted onto the top end 30 of the storage body 26, the rod 48 of each latch 42 is positioned behind one of the catch members 50. With the rod 48 in place, the actuator handle 44 is moved from the position shown in FIG. 3 to the closed position shown in FIG. 2. The mud supply head 32 is secured on the storage body 26 in this manner.

Referring to FIG. 7, the difference in the outer diameter of the main portion of the body 34 of the mud supply head 32 and the mounting portion 36 of the mud supply head 32 creates an annular mounting seat 58 which engages the outer rim 60 of the storage body 26. The mud supply head 32 contains a centrally located internal mud passageway 62. The mud passageway 62 provides communication between the internal open area 27 of the storage body 26 and the top surface 64 of the supply head 32.

A shut-off valve 66 having a threaded stem 68 screws into an internally threaded portion 70 of the mud passageway 62. The threaded portion 70 extends longitudinally into the mud supply head 32 from the top surface 64. The shut-off valve 66 also has an internal passageway (not shown) that allows mud or liquid to pass through the valve 66 and out an external threaded connector 72 when the valve 66 is open.

The internal passageway of the shut-off valve 66 is preferably in axial alignment with the mud passageway 62.

The shut-off valve 66 has a handle 74 to open and close the shut-off valve 66. The shut-off valve 66 is open when the longitudinal axis of the actuator handle 74 is parallel to the longitudinal length of the storage body 26, as shown in FIGS. 3 and 7. To close the shut-off valve 66, the actuator handle 74 is rotated 90° so that the actuator handle 74 is perpendicular to the longitudinal length of the storage body 26.

A one-way fill valve 76 is mounted onto the mud supply head 32. A variety of one-way valves can be used, such as poppet valves or ball and seat valves. The fill valve 76 shown in the drawings has a threaded surface 88 that engages an internally threaded bore in the mud supply head 32. The fill valve 76 has a pump connection portion 78 that provides a connection location for a hose from a mud pump 92. The fill valve 76 has an internal fill passageway 80. The internal fill passageway 80 has a ball seat 82 that receives a ball 84. The fill passageway 80 in the fill valve 76 is in axial alignment with a filling passageway 86 in the mud supply head 22. The filling passageway 86 in the mud supply head 22 intersects the main mud passageway 62.

Joint compound is pumped out of the supply container 90 by a pump 92, and enters the fill valve 76. As the joint compound enters the fill valve 76, it pushes the ball 84 away from the ball seat 82 so that the ball 84 contacts the stop member 94. Stop member 94 contains a series of openings 96 that allow joint compound to flow around the ball 84 and into the filling passageway 86. If the shut-off valve 66 is closed, the supply of joint compound will then flow into the internal open area 27 of the storage body 26 to fill the dispenser 10.

Referring to FIG. 4, a power supply head 96 is removably connected to the bottom end 28 of the storage body 26. The power supply head 96 contains a generally cylindrical body 98 having an outer diameter slightly larger than the outside diameter of the storage body 26. The power supply head 96 has an integral cylindrical mounting portion 100. The mounting portion 100 of the power supply head 96 has an outer diameter size slightly smaller than the internal diameter of the bottom end 28 so that the mounting portion 100 can be positioned within the bottom end 28 of the storage body 26.

A rubber seal 102 surrounds the outside diameter of the mounting portion 100. The rubber seal 102 is retained in a circumferential notch 104 extending around the outer surface of the mounting portion 100. The rubber seal 102 interacts with the inner wall 40 of the storage body 26 (see FIG. 5). When the mounting portion 100 of the power supply head 96 is inserted into the bottom end 28 of the storage body 26, the rubber seal 102 interacts with the inner wall 40 of the storage body 26 to provide a liquid and air-tight seal.

Referring again to FIG. 4, a second pair of latches 106 are securely connected to the power supply head 96. The pair of latches 106 are identical to those contained on the mud supply head 32. The latches 106 have an actuation handle 108, an attachment body 110, and a rod 112. A pair of catch members 114 are securely connected to a metal band 116 that surrounds the outer diameter of the storage body 26 and is spaced longitudinally from the bottom end 28. The metal band 116 is received by a circumferential notch 118 formed in the outer wall 25 of the storage body 26. The pair of latches 106 operate in an identical fashion to the pair of latches 42 contained on the supply head 32.

The difference in the diameter of the main portion of the body 98 of the power supply head and the mounting portion 100 of the body 98 creates an annular mounting seat 120 that engages the bottom outer rim 122 of the storage body 26. The power supply head 96 contains a centrally located internal air passageway 124. The air passageway 124 provides communication between the internal open area 27 of the storage body 26 and the outer face 126 of the inlet head 96.

Figures 8, 9, 10:
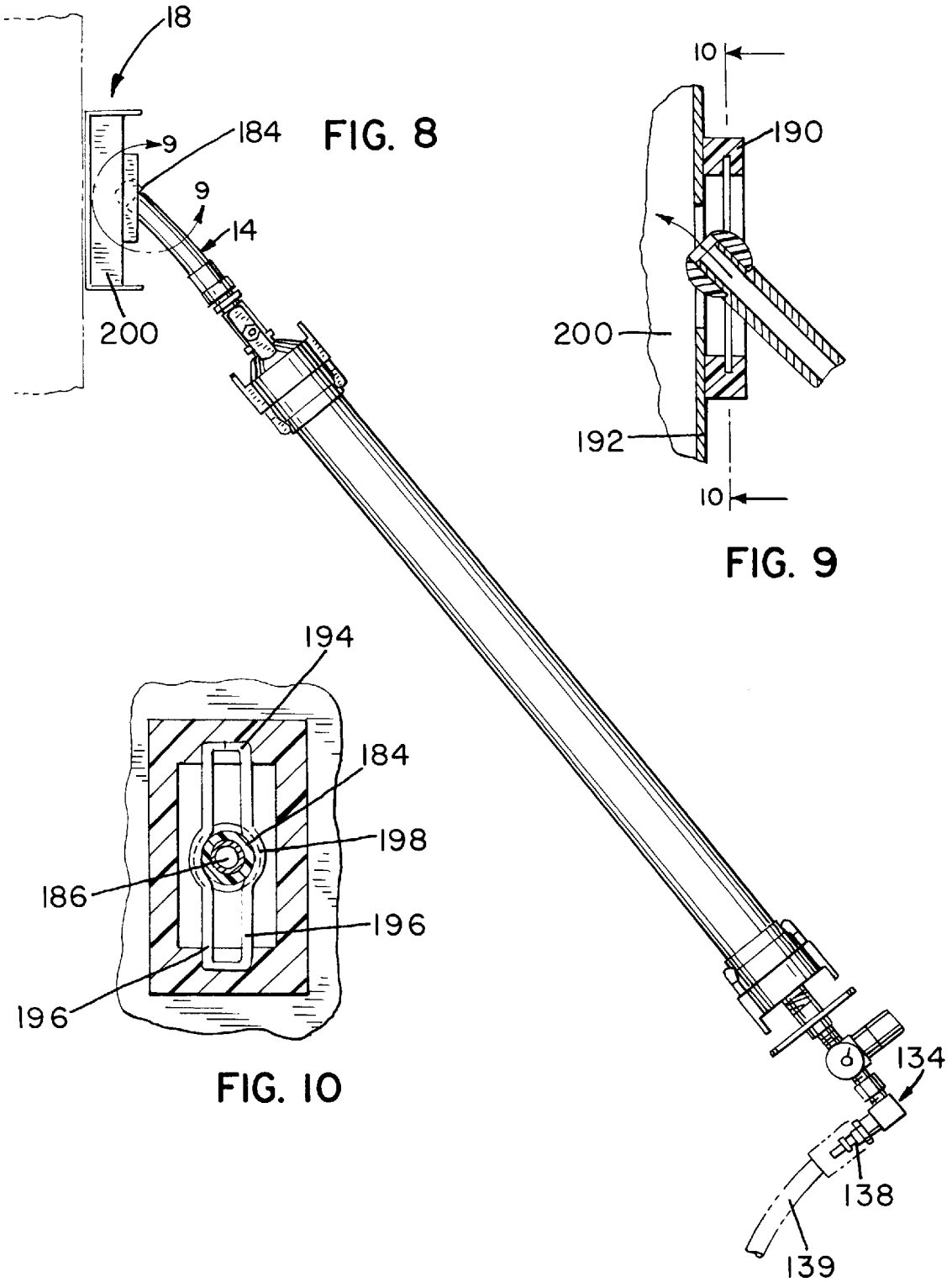
FIG. 8 is a side elevational view of the apparatus in accordance with the invention used with a flat box for applying joint compound.
FIG. 9 is a detailed cross sectional view showing the interaction between the applicator tip and the flat box.
FIG. 10 is a partial cross-sectional view taken along line 10—10 of FIG. 9.

As shown in FIG. 2, an air supply control assembly 128 is attached to the power supply head 96. The air supply control assembly 128 consists of an actuator 130, a pressure regulator 132, an air supply connector 134 and a pressure relief valve 136. The air supply connector 134 is connected to a supply of compressed air (e.g. an air compressor, not shown) by a quick disconnect fitting 138 through an air hose 139 (FIG. 8). Air entering the quick disconnect fitting 138 flows through the air supply connector 134 until it reaches the pressure regulator 132.

Pressure regulator 132 has of an adjustment knob 140 and a readout dial 142. As shown in FIG. 1, the readout dial 142 has a measuring needle 144 that provides a visual indication of the air pressure passing through the pressure regulator 132. The adjustment knob 140 can be rotated to increase or decrease the pressure from the source of compressed air.

Referring now to FIG. 5, the pressure regulator 132 is connected to the actuator 130 by an externally threaded connector 146. The actuator 130 has an internal air passageway (not shown). An attachment nut 148 securely positions an actuator handle 150 between the nut 148 and the actuator body 152. When the actuator handle is in the relaxed position shown in FIG. 5, the actuator 130 is closed, and compressed air is prevented from passing through the actuator 130.

To open the actuator 130, the actuator handle 150 is pivoted about its longitudinal center as shown in phantom in FIG. 5. The pivoting movement of the actuator handle 150 causes the actuator body 152 to move longitudinally along an internal shaft 154. This movement causes the internal air passageway (not shown) within the actuator 130 to be opened and allows compressed air to flow through the actuator 130. The compressed air then flows through an externally threaded connector 156 and into the internal air passageway 124 in the power supply head 96. The compressed air is then introduced into the internal open area 27. When the user releases the actuator handle 150, the return spring 158 surrounding the shaft 154 provides the return bias force to return the actuator handle 150 to the relaxed position. The actuator 130 has a vent that opens when the actuator handle 150 is in the relaxed position. When the actuator handle 150 is in the relaxed position, the air pressure within the storage body 26 is returned to atmospheric pressure.

Referring to FIGS. 1–5 and 6, a movable plunger 160 is positioned within the internal open area 27 of the storage body 26. The plunger 160 can move along the entire longitudinal length of the storage body 26 between the mud supply head 32 and the power supply head 96. The plunger 160 has a generally cylindrical body 162 having an outer circumference slightly smaller than the internal diameter of the storage body 26. The plunger body 162 is a solid structure terminating at one end in a circular air face 164 and terminating at the other head in a circular mud face 166. Referring in particular to FIG. 5, the longitudinal length of the body 162 is parallel to longitudinal length of the storage body 26. The plunger 160 contains a rubber air seal 168 and a rubber mud seal 170. The air seal 168 is longitudinally spaced from the air face 164 and surrounds the circumference of the plunger body 162.

Referring in particular to FIG. 6, the air seal 168 is securely retained in notch 172 created in the outer circumference of the plunger body 162. Likewise, mud seal 170 is longitudinally spaced from the mud face 166 and is received in a notch 174 contained in the outer circumference of the plunger body 162. The air seal 168 is a rubber seal having a U-shaped cross section open toward the power supply head 96 when the plunger 160 is positioned within the storage body 26. More specifically, the preferred air seal 168 has a cross-section defined by a radially extending wall, an inner transverse wall extending longitudinally from an inner portion of the radially extending wall towards the power supply head 96, and an outer transverse wall extending longitudinally from an outer portion of the radially extending wall towards the power supply head 96. The air seal 168 creates an air-tight seal between the plunger body 162 and the inner wall 40 of the storage body 26 so that compressed air introduced into the internal open area 27 of the storage body 26 cannot pass any further than the air seal 168. Therefore, the air seal 168 contained on the plunger body 162 and the rubber seal 102 contained on the mounting portion 100 of the inlet head 96 creates a pressure chamber 176 within the storage body 26.

On the other end of the plunger body 162, the mud seal 170 is positioned so that its U-shaped cross section is open toward the mud supply head 32. The mud seal 170 preferably has the same construction as the air seal 168, except the mud seal 170 faces the opposite direction. The mud seal 170 creates an air and fluid tight seal between the plunger body 162 and the inner wall 40 of the storage body 26. The mud seal 170 and the rubber seal 38 on the mounting portion 36 of the supply head 32 thus create a mud chamber 178 (FIG. 7). Since the plunger 160 is movable within the storage body 26, the respective lengths of both the pressure chamber 176 and the mud chamber 178 vary depending upon the position of the plunger 160.

In the preferred embodiment of the invention, a lubricating strip 180, preferably made of felt, is positioned around the plunger body 162 between the mud seal 170 and the air seal 168. The lubricating strip 180 contacts the inner wall 40 of the storage body 26 and preferably contains a source of lubrication such as water or liquid soap. As the plunger 160 moves within the storage body 26, the lubricating strip moistens the inner wall 40 so that the mud seal 170 and the air seal 168 can pass over the inner wall 40 smoothly.

Although not shown in the Figures, the pressure relief valve 136 (FIG. 2) communicates with the pressure chamber 176 through the air passageway 124 contained in the inlet head 96. The pressure relief valve 136 is set at a desired value. If the air pressure within the pressure chamber 176 exceeds a desired value, the pressure relief valve 136 opens to relieve the pressure within the pressure chamber 176.

FIGS. 2 and 3 show the applicator tip 14 that is removably connected to the externally threaded connector 72 on the shut-off valve 66. The applicator tip 14 is generally comprised of a hollow stem 182 and a universal mounting ball 184. The stem 182 is a tubular structure having an outer wall surrounding a joint compound passageway 186. The hollow stem 182 terminates with an internally threaded connector 188 at one end and the universal mounting ball 184 at the other. The joint compound passageway 186 extends through the stem 182 through the mounting ball 184, and through the connector 188. The joint compound passageway 186 for the applicator tip 14 is in axial alignment and communicates with the internal passageway in the shut-off valve 66. In this manner, joint compound from the mud chamber 178 contained within the storage body 26 can pass through the mud passageway 62 in the mud supply head 32, through the shut-off valve 66 and finally through the applicator tip 14 and out the mounting ball 184. The mounting ball 184 facilitates connection between the applicator tip 14 and a wide variety of conventional and non-conventional attachments.

The operation of the common dispenser 12 with the applicator tip 14 attached will now be described. In preparation for use, both the mud supply head 32 and the power supply head 96 are attached to the storage body 26 by the latches 42 and 106. Once the mud supply head 32 and the power supply head 96 are attached (FIG. 2), the air supply connector 134 is connected to a compressor, preferably a portable compressor or any other equivalent source of compressed air.

To fill the storage body, the first step is to close the shut-off valve 66 by rotating the actuator handle 74 90° from the position shown in FIG. 7. With the shut-off valve 66 closed, the fill valve 76 is connected to pump 92 which pumps joint compound from a supply container 90. The pump 92 forces joint compound through internal passageway 80 in the fill valve 76. The joint compound then flows past ball 84; into the filling passageway 86; and because the shut-off valve 66 is closed, the joint compound travels through the mud passageway 62 and into the mud chamber 178 in the storage body 26, as shown by the broken arrow in FIG. 7.

As the mud chamber 178 begins to fill, the pressure of the joint compound on mud face 166 of the plunger 160 causes the plunger 160 to move along the longitudinal length of the storage body 26 away from the mud supply head 32. The mud seal 170 on the plunger 160 prevents joint compound from exiting the mud chamber 178. Joint compound can be continuously supplied by pump 92 until the plunger 160 reaches the power supply head 96. At this time, the mud chamber 178 comprises almost the entire length of storage body 26. The pump 92 is then disconnected from the fill valve 76 and the shut-off valve 66 re-opened.

With the mud chamber 178 full (or even partially full) of joint compound the user can then proceed to apply joint compound as needed. To do this, the user pivots the actuator handle 150, as shown in FIG. 5, to supply pressurized air through the air passageway 124 into pressure chamber 176. As the air pressure in pressure chamber 176 increases, the pressure on air face 164 pushes the plunger 160 away from the power supply head 96 which expands the pressure chamber 176. Movement of the plunger 160 causes the joint compound contained in the mud chamber 176 to be pushed out the mud passageway 62. With the shut-off valve 66 open, joint compound flows through the shut-off valve 66, through the applicator tip 14, finally exiting through the mounting ball 184. If the amount of joint compound exiting the mounting ball 184 is too much or too little, the user can adjust the air pressure by rotating adjustment knob 140 contained on the pressure regulator 132.

When the user wishes to cease applying joint compound, the user releases the actuator handle 150. Return spring 158 then returns the actuator body 152 to its resting position at which time the supply of pressurized air is cut-off from the pressure chamber 176. This process can be continued until the entire supply of joint compound contained within the mud chamber 178 is pushed out through the mounting ball 184. Then, the mud chamber 178 in the storage body 26 can be filled again and the process repeated.

After completing a drywall job, the user can remove the supply head 32 and use the air pressure and plunger 160 to discharge any unused joint compound from the mud chamber 178.

Although the operation of the mud applicator has been described with only the applicator tip 14, it is preferred that a corner joint attachment 16 or a flat joint attachment 18 be mounted to the mounting ball 184 when applying joint compound over drywall corner joint or flat joints. FIGS. 8–10 show a flat joint attachment 18 mounted on the applicator tip 14. With the flat joint attachment 18, joint compound can be applied over long flat surfaces, particularly long horizontal or vertical joints between adjacent sheets of drywall.

The flat joint attachment 18 has a mounting portion 190 that extends above the body 192 of the flat joint attachment 18. The mounting portion 190 of the flat joint attachment 18 has a retaining structure 194. The retaining structure 194 has a pair of parallel wire elements 196 each having a bowed-out mounting portion 198. The pair of bowed-out mounting portions 198 define a generally circular opening that is smaller in diameter than the mounting ball 184. To mount the flat joint attachment 18 to the applicator tip 14, the mounting ball 184 is pressed between the bowed mounting portion 198 contained on each wire element 196. The wire elements 196 flex outward to allow the mounting ball 184 to pass through the bowed-out mounting portion 198. Once inserted, the mounting ball 184 is securely but rotatably connected to the flat joint attachment 18 18. When positioned as such, the joint compound passageway 186 is in communication with an open storage area 200 in the flat joint attachment 18. The flat joint attachment 18 operates in the conventional manner to apply joint compound.

The above method of mounting the flat joint attachment 18 is well known in the prior art. A similar mounting structure is also provided on the corner joint attachment 16. Discussion will therefore be omitted.

Like the flat joint attachment 18, a corner joint attachment 16 can be used. The operation of both the corner joint attachment 16 and the flat joint attachment 18 will be omitted since the operation of each of these devices is well known in the prior art.

In addition to the removable corner joint attachment 16 and flat joint attachment 18, a conventional joint box in which the flat joint attachment 18 is securely mounted to a structure similar to the applicator tip 14 is contemplated. The conventional joint box with an integral stem is a common component in the drywall industry and can be used with the mud applicator of the invention, thereby eliminating the need to replace components the user may already possess. Additionally, a corner joint attachment 16 securely connected to an applicator tip 14 is also considered to be a possible attachment to the mud applicator.

An advantage of the present invention is that by using a source of compressed air to supply the joint compound, the amount of joint compound being supplied to the surface can be increased. Therefore, when either the corner joint attachment 16 or the flat joint attachment 18 is used, the attachment tends to hydroplane slightly over the supply of joint compound which reduces the possibility of tearing the mudless tape or mesh. Additionally, since the supply of joint compound is controlled by the actuator handle 150, the corner joint attachment 16 and the flat joint attachment 18 can be operated in any direction, unlike many of the prior art systems in which the joint boxes can only be operated in one direction.

Figures 11, 12, 13:
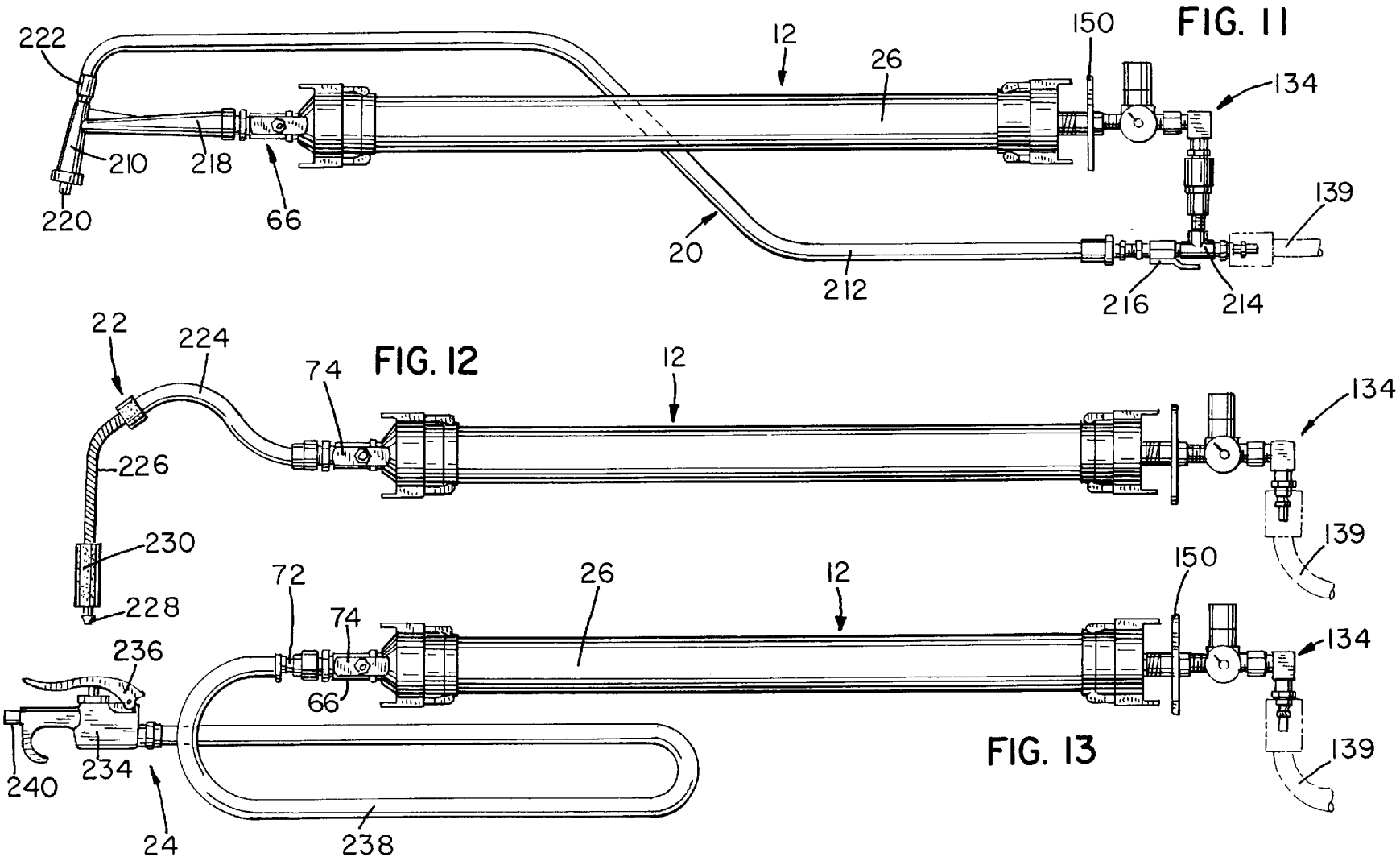
FIG. 11 is a side elevational view showing the joint compound texture apparatus.
FIG. 12 is a side elevational view showing the fireproofing apparatus.
FIG. 13 is a side elevational view showing the water spray apparatus.

Although the invention has been described as being particularly useful in applying joint compound over flat or corner joints between sections of drywall. FIGS. 11–13 show three additional attachments which expand the number of functions that can be performed with the dispenser 17.

FIG. 11 shows a texture gun attachment 20 attached to the common dispenser 12. The texture gun attachment 20 consists of a spray nozzle 210, an air hose 212, an air connector 214 and an actuator 216. In operation, the storage body 26 is filled with joint compound and the shut-off valve 66 opened. The actuator 216 is opened such that the supply of compressed air can flow through the air hose 212 to the nozzle 210. The connector 222 between the air hose 212 and the nozzle 210 is located behind the stem 218 of the nozzle 210, allowing the source of pressurized air to continuously flow through the air hose 212 and out the nozzle tip 220. To supply joint compound to the nozzle 210, the actuator handle 150 is pivoted as previously discussed. The movable plunger 160 (not shown) forces the joint compound through the stem 218. Since compressed air is supplied to the nozzle 210 at the connector 222, the joint compound entering through stem 218 is forced out the nozzle tip 220 by this compressed air. The compressed air therefore causes the joint compound to be sprayed forward from the nozzle tip 220, creating the textured effect desired. Therefore, the common dispenser 12 and the texture gun attachment 20 can replace a conventional texture gun which normally needs to be purchased separately.

Referring to FIG. 12, a fireproofing attachment 22 is shown connected to the common dispenser 12. The fireproofing attachment 22 consists of a flexible hose 224 securely connected to a deformable metal applicator 226. The metal applicator 226 terminates at a rounded applicator tip 228. Spaced from the applicator tip 228 along the metal applicator 226 is a pad 230. The fireproofing attachment 22 is particularly useful in applying a bead of joint compound around a pipe extending through a section of drywall. To do this, the applicator tip 28 is placed between the outer diameter of the pipe and the section of drywall. The pad 230 allows the user to securely grip the fireproofing attachment 22 and provides the desired spacing between the applicator tip 228 and the outer surface of the drywall. Although the applicator tip 14 could be used to apply the bead of joint compound around the pipe, the fireproofing attachment 22 is flexible and allows the user a greater degree of mobility.

Referring to FIG. 13, a water cleaning attachment 24 is shown connected to the common dispenser. The water cleaning attachment 24 has a hose 238, and a spray nozzle 234 having a trigger switch 236. The water hose 238 connects the spray nozzle 234 to the threaded connector 72 contained on the shut-off valve 66. To use the water attachment 24, the user first fills the storage body 26 with a supply of water. Once the storage body 26 is full, the user can pivot the actuator handle 150 which causes the plunger 160 to force the water out of the storage body 26 and into the water hose 238. With the actuator handle 150 in its pivoted position, the user can then depress trigger switch 236 which will allow water to exit the spray nozzle 240. In this manner, the common dispenser 12 provides a source of pressurized water which is particularly useful in cleaning the drywall tools.

It is contemplated by the inventors that the externally powered driving source, which was described as being compressed air, could be replaced by a variety of mechanical alternatives, such as but not limited to an electrically powered motor connected by a screw mechanism to the plunger.

Various modifications, alternatives and equivalents to the invention shown in the drawings and described above may be apparent to those skilled in the art and the following claims should be interpreted to include such modifications, alternatives or equivalents.

We claim:

1. An apparatus for supplying joint compound to be applied over a joint between sections of wallboard, the apparatus comprising:

a hollow storage body for holding a supply of joint compound, the hollow storage body extending along a longitudinal axis and having a top end and a bottom end;

a power supply head connected to the bottom end of the hollow storage body;

a mud supply head connected to the top end of the hollow storage body, the mud supply head having a joint compound passageway;

a movable plunger positioned within the interior of the hollow storage body between the power supply head and the supply of joint compound;

an externally powered driving source in communication with the power supply head that provides a driving force to the movable plunger, the driving force being selectively applied to push the plunger toward the mud supply head so that the plunger pushes the supply of joint compound out of the hollow storage body through the joint compound passageway in the mud supply head; and an applicator tip removably connected to the mud supply head, wherein the applicator tip comprises:

an applicator stem;

a mounting ball integral with the applicator stem; and an applicator tip passageway passing through the applicator stem and the mounting ball, the applicator tip passageway receiving joint compound passing through the joint compound passageway in the mud supply head and outputting joint compound through the mounting ball.

2. The apparatus as recited in claim 1 wherein the hollow storage body is an elongated cylindrical tube having a smooth inner wall.

3. The apparatus as recited in claim 2 wherein the hollow storage body has a length of between approximately 1 ft. and 7 ft.

4. The apparatus as recited in claim 1 wherein the hollow storage body is constructed from a transparent material.

5. The apparatus as recited in claim 1 wherein the mud supply head is removably connected to the top end of the hollow storage body.

6. The apparatus as recited in claim 5 wherein the connection between the hollow storage body and the removable mud supply head is a pair of latches securely mounted to the mud supply head and received by a pair of catches mounted to the storage body.

7. The apparatus as recited in claim 1 wherein the power supply head is removably connected to the top end of the hollow storage body.

8. The apparatus as recited in claim 7 wherein the connection between the hollow storage body and the removable power supply head is a pair of latches securely mounted to the power supply head and received by a pair of catches mounted to the storage body.

9. The apparatus as recited in claim 1 further comprising a shut-off valve positioned between the hollow storage body and the applicator tip so that the shut-off valve can be closed to selectively prevent the flow of joint compound through the applicator passageway in the applicator tip.

10. The apparatus as recited in claim 1 wherein the externally powered driving source is an air compressor and the driving force is pressurized air pushing against the plunger.

11. The apparatus as recited in claim 10 further comprising an actuator positioned between the air compressor and the hollow storage body, the actuator being operable between an open and a resting position, the applicator venting the storage body to atmospheric pressure in the resting position.

12. The apparatus of claim 10 further comprising a pressure regulator positioned between the air compressor and the hollow storage body to regulate air pressure against the plunger.

13. The apparatus as recited in claim 12 further comprising a pressure relief valve that relieves air pressure pushing against the plunger when the air pressure pushing against the plunger exceeds a set value.

14. The apparatus as recited in claim 10 wherein the movable plunger comprises:

a plunger body having an effective outer diameter slightly smaller than the internal diameter of the hollow storage body to permit the movement of the plunger along the longitudinal axis of the hollow storage body;

a circular air face contained on the end of the plunger body facing the power supply head;

a circular mud face contained on the end of the plunger body opposite the air face and facing the mud supply head;

an air seal around the plunger body and contacting the inner wall of the hollow storage body to prevent compressed air from passing thereby;

a mud seal around to the plunger body and contacting the inner wall of the hollow storage body to prevent joint compound from passing thereby.

15. The apparatus as recited in claim 14 wherein the mud seal and the air seal are rubber.

16. The apparatus as recited in claim 14 wherein the mud seal and the air seal each have a cross-section defined by a radially extending wall, an inner transverse wall extending longitudinally from an inner portion of the radially extending wall towards the respective end of the hollow storage body, and an outer transverse wall extending longitudinally from an outer portion of the radially extending wall towards the respective end of the hollow storage body.

17. The apparatus as recited in claim 14 wherein the movable plunger further comprises a lubricating strip around the plunger body between the air seal and the mud seal, the lubricating strip contacting the inner wall of the hollow storage body.

18. The apparatus as recited in claim 17 herein the lubricating strip comprises felt.

19. The apparatus as recited in claim 18 wherein the felt is moistened.

20. The apparatus as recited in claim 1 wherein the mud supply head includes a one-way valve for the insertion of joint compound through the mud supply head into the storage body.

21. An apparatus for supplying joint compound to be applied over a joint between sections of wallboard, the apparatus comprising:

a tubular storage body for holding a supply of joint compound, the tubular storage body having a top end, a bottom end and a smooth inner wall extending the longitudinal length of the tubular storage body;

a power supply head connected to the bottom end of the tubular storage body;

a mud supply head connected to the top end of the tubular storage body;

an applicator connected to the mud supply head;

a movable plunger positioned within the inner wall of the tubular storage body between the power supply head and the supply of joint compound;

a source of compressed air connected to the power supply head and providing pressurized air against the movable plunger, the pressurized air being selectively applied to the plunger to push the plunger toward the mud supply head so that the plunger pushes the supply of joint compound out through the applicator;

a mud seal contained on the plunger and positioned to interact with the inner wall of the tubular storage body to prevent joint compound from passing thereby;

an air seal contained on the plunger and positioned to interact with the inner wall of the tubular storage body to prevent compressed air from passing thereby; and an actuator positioned between the source of compressed air and the tubular storage body which is operable between an open position and a resting position, wherein the actuator vents the tubular storage body to the atmosphere when the actuator is in the resting position.

22. The apparatus as recited in claim 21 further comprising a shut-off valve connected to the mud supply head that regulates flow of joint compound through the applicator.

23. The apparatus as recited in claim 21 wherein the mud seal and the air seal each have a cross-section defined by a radially extending wall, an inner transverse wall extending longitudinally from an inner portion of the radially extending wall towards the respective end of the tubular storage body, and an outer transverse wall extending longitudinally from an outer portion of the radially extending wall towards the respective end of the tubular storage body.

24. An apparatus as recited in claim 21 further comprising a pressure regulator positioned between the source of compressed air and the tubular storage body to regulate air pressure against the plunger.

25. An apparatus as recited in claim 24 wherein the pressure regulator is adjustable.

26. A kit comprising:

a dispenser including:

a hollow storage body having a top end and a bottom end, a material supply head connected to the top end of the hollow storage body, an applicator tip removably mountable to the material supply head, the applicator tip having a mounting ball and being in communication with material contained in the hollow storage body, a power supply head connected to the bottom end of the hollow storage body, the power supply head being connectable to a source of compressed air;

a movable plunger positioned within the interior of the hollow storage body between the power supply head and the material in the hollow storage body;

a corner joint attachment removably mountable to the mounting ball on the applicator tip; and a flat joint attachment removably mountable to the material supply head.

27. An apparatus for dispensing liquified material comprising:

a tubular storage body for holding a supply of liquified material, the tubular storage body having a top end, a bottom end and a smooth inner wall extending the longitudinal length of the tubular storage body;

a power supply head connected to the bottom end of the tubular storage body;

a liquified material supply head connected to the top end of the tubular storage body;

an applicator connected to the liquified material supply head;

a movable plunger positioned within the inner wall of the tubular storage body between the power supply head and the supply of liquified material;

a source of compressed air connected to the power supply head and providing pressurized air against the movable plunger, the pressurized air being selectively applied to the plunger to push the plunger toward the supply head so that the plunger pushes the supply of liquified material out through the applicator;

a liquified material seal contained on the plunger and positioned to interact with the inner wall of the tubular storage body to prevent liquified material from passing thereby;

an air seal contained on the plunger and positioned to interact with the inner wall of the tubular storage body to prevent compressed air from passing thereby; and a lubricating strip located around the plunger body between the mud seal and the air seal and contacting the smooth inner wall of the hollow storage body.

28. The apparatus as recited in claim 27 wherein the mud seal and the air seal each have a cross-section defined by a radially extending wall, an inner transverse wall extending longitudinally from an inner portion of the radially extending wall towards the respective end of the tubular storage body, and an outer transverse wall extending longitudinally from an outer portion of the radially extending wall towards the respective end of the tubular storage body.

29. The apparatus as recited in claim 27 wherein the lubricating strip comprises felt.

30. The apparatus as recited in claim 29 wherein the felt is moistened.

31. The apparatus as recited in claim 30 wherein the felt is moistened with liquid soap.

* * * * *